US006176080B1

(12) United States Patent
Izumiura et al.

(10) Patent No.: US 6,176,080 B1
(45) Date of Patent: Jan. 23, 2001

(54) OXYGEN CONCENTRATION SENSOR ABNORMALITY-DETECTING SYSTEM FOR INTERNAL COMBUSTION ENGINES

(75) Inventors: Atsushi Izumiura; Akira Murakami; Hirohisa Kitaura; Seiichi Hosogai; Shigeo Hidai, all of Wako (JP)

(73) Assignee: Honda Giken Kogyo Kabushiki Kaisha, Tokyo (JP)

( * ) Notice: Under 35 U.S.C. 154(b), the term of this patent shall be extended for 0 days.

(21) Appl. No.: 09/150,207

(22) Filed: Sep. 9, 1998

(30) Foreign Application Priority Data

Sep. 10, 1997 (JP) ..... 9-261127

(51) Int. Cl.[7] ..... F01N 3/00

(52) U.S. Cl. ..... 60/276; 60/277; 60/274; 73/118.1; 73/23.31; 73/23.32; 123/688

(58) Field of Search ..... 60/276, 277, 274; 123/688; 73/23.32, 118.1, 23.31; 340/439

(56) References Cited

U.S. PATENT DOCUMENTS 5,154,054 * 10/1992 Nakane et al. ..... 60/276
5,331,808 * 7/1994 Koike ..... 60/276
5,363,091 * 11/1994 Kotwicki et al. ..... 340/439
5,365,216 * 11/1994 Kotwicki et al. ..... 340/439
5,396,766 * 3/1995 Sato et al. ..... 60/276
5,485,382 * 1/1996 Seki et al. ..... 364/431.05
5,513,522 * 5/1996 Seki et al. ..... 73/118.1
5,568,725 * 10/1996 Uchikawa ..... 60/274
5,577,488 * 11/1996 Sato ..... 123/688
5,610,321 * 3/1997 Shinmoto ..... 73/23.32
5,845,489 * 12/1998 Dohta et al. ..... 60/276

FOREIGN PATENT DOCUMENTS 62-28675 7/1987 (JP) .

* cited by examiner

*Primary Examiner*—Thomas Denion
*Assistant Examiner*—Thai-Ba Trieu
(74) *Attorney, Agent, or Firm*—Arent Fox Kintner Plotkin & Kahn, PLLC

(57) ABSTRACT

An oxygen concentration sensor abnormality-detecting system is provided for an internal combustion engine having first and second oxygen concentration sensors arranged in the exhaust system upstream and downstream of a catalytic converter therein. An ECU determines that the first oxygen concentration sensor is functioning abnormally if an output from the first oxygen concentration sensor does not change when an output from the second oxygen concentration sensor changes.

3 Claims, 5 Drawing Sheets

OXYGEN CONCENTRATION SENSOR ABNORMALITY-DETECTING SYSTEM FOR INTERNAL COMBUSTION ENGINES

BACKGROUND OF THE INVENTION

1. Field of the Invention

This invention relates to an oxygen concentration sensor abnormality-detecting system for internal combustion engines, which detects abnormality of an oxygen concentration sensor arranged in the exhaust system of the engine at a location upstream of a catalytic converter arranged therein.

2. Prior Art

To detect abnormality of an oxygen concentration sensor arranged in the exhaust system of an internal combustion engine at a location upstream of a catalytic converter arranged therein, an oxygen concentration sensor abnormality-detecting system has been proposed by Japanese Utility Model Publication (Kokoku) No. 62-28675, which determines that the oxygen concentration sensor is abnormal if the output level of the oxygen concentration sensor remains less than a predetermined value, i.e. stays on a lean side when an increased amount of fuel is supplied to the engine.

According to this abnormality-detecting system, however, the detection of abnormality of the oxygen concentration sensor has to be carried out only when the amount of fuel supplied to the engine is increased. On the other hand, from the standpoint of fuel economy, it is required that the frequency of increase of the fuel amount supplied to the engine should be as low as possible. Consequently, the detection of abnormality of the oxygen concentration sensor cannot be carried out so long as no increase of the fuel amount supplied to the engine is required, resulting in a very low frequency of execution of the abnormality detection.

Further, a gas engine in particular undergoes large variations in the air-fuel ratio of a mixture supplied to the engine due to variations in the composition of the fuel such that the air-fuel ratio of the mixture cannot be surely enriched even when the fuel supply amount is controlled to an increased amount, which can result in an erroneous detection of abnormality of the oxygen concentration sensor.

SUMMARY OF THE INVENTION

It is an object of the invention to provide an oxygen concentration sensor abnormality-detecting system for internal combustion engines, which is capable of detecting abnormality of an oxygen concentration sensor upstream of a catalytic converter without the detection timing being limited to occasions of increase of the fuel amount supplied to the engine.

Another object of the invention is to accurately detect abnormality of an oxygen concentration sensor upstream of a catalytic converter without erroneous detection.

To attain the above objects, the present invention provides an oxygen concentration sensor abnormality-detecting system for an internal combustion engine having an exhaust system, a catalytic converter arranged in the exhaust system, first and second oxygen concentration sensors arranged in the exhaust system at respective locations upstream and downstream of the catalytic converter, comprising abnormality-determining means for determining that the first oxygen concentration sensor is functioning abnormally if an output from the first oxygen concentration sensor does not change when an output from the second oxygen concentration sensor changes.

According to the above manner of abnormality detection, it is possible to detect abnormality of the first oxygen concentration sensor upstream of the catalytic converter without the detection timing being limited to occasions of increase of the fuel amount supplied to the engine, as well as largely reduce the possibility of erroneous detection as to abnormality of the first oxygen concentration sensor.

Preferably, the abnormality-determining means determines that the first oxygen concentration sensor is functioning abnormally if the output from the first oxygen concentration sensor stays in a direction such that an air-fuel ratio of a mixture supplied to the engine is leaner than a stoichiometric air-fuel ratio when the output from the second oxygen concentration sensor has changed in a direction such that the air-fuel ratio of the mixture is richer than the stoichiometric air-fuel ratio.

More preferably, the abnormality-determining means determines that the first oxygen concentration sensor is functioning abnormally if the output from the first oxygen concentration sensor has continued to indicate that an air-fuel ratio of a mixture supplied to the engine is leaner than a stoichiometric air-fuel ratio, over a predetermined time period when the output from the second oxygen concentration sensor indicates that the air-fuel ratio of the mixture is richer than the stoichiometric air-fuel ratio.

According to the above manner of abnormality detection, erroneous detection of abnormality of the first oxygen concentration sensor can be avoided even in the case where the air-fuel ratio cannot be positively made rich.

The above and other objects, features, and advantages of the invention will become more apparent from the following detailed description taken in conjunction with the accompanying drawings.

DETAILED DESCRIPTION

The invention will now be described in detail with reference to drawings showing an embodiment thereof.

Figure 1:
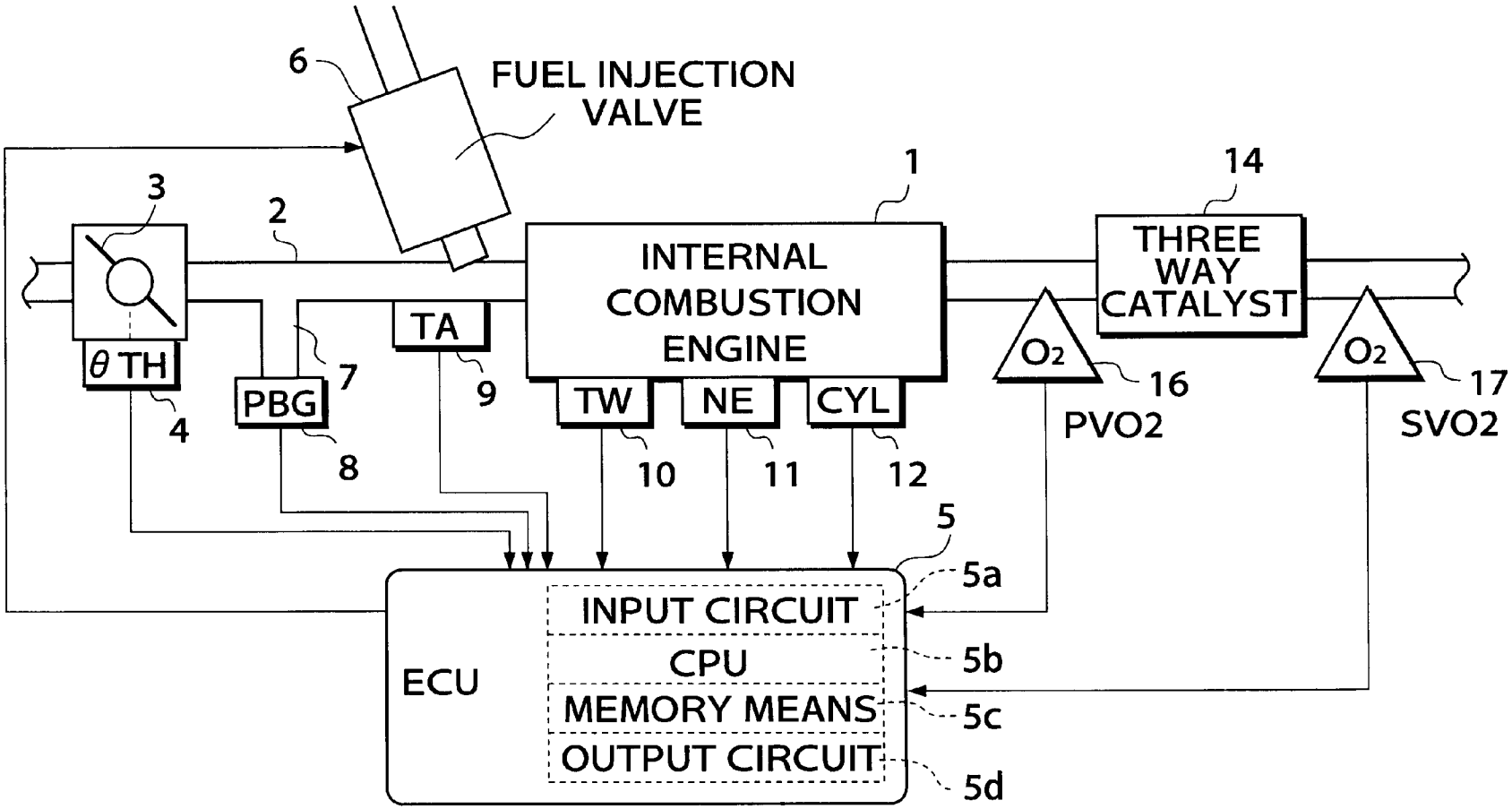
FIG. 1 is a block diagram showing the whole arrangement of an internal combustion engine and an oxygen concentration sensor abnormality-detecting system therefor, according to an embodiment of the invention.

Referring first to FIG. 1, there is schematically shown the whole arrangement of an internal combustion engine and an oxygen concentration sensor abnormality-detecting system therefor, according to an embodiment of the invention.

In the figure, reference numeral 1 designates an internal combustion engine (hereinafter referred to as "the engine"), which has an intake pipe 2 connected to the cylinder block thereof, across which is arranged a throttle valve 3. A throttle valve opening (θTH) sensor 4 is connected to the throttle valve 3, for generating an electric signal indicative of the sensed throttle valve opening θTH to an electronic control unit (hereinafter referred to as "the ECU") 5.

Fuel injection valves 6, only one of which is shown, are each provided for each cylinder and arranged in the intake pipe 2 at a location between the engine 1 and the throttle valve 3 and slightly upstream of an intake valve, not shown. Each fuel injection valve 6 is connected to a fuel pump, not shown, and electrically connected to the ECU 5 to have its valve opening period controlled by a signal therefrom.

On the other hand, an intake pipe negative pressure (PBG) sensor 8 is connected to the intake pipe 2 via a conduit 7 at a location immediately downstream of the throttle valve 3 for sensing negative pressure (PBG) within the intake pipe 2, and is electrically connected to the ECU 5 for supplying an electric signal indicative of the sensed negative pressure PBG to the ECU 5. Further, an intake air temperature (TA) sensor 9 is inserted into the intake pipe 2 at a location downstream of the PBG sensor 8, for supplying an electric signal indicative of the sensed intake air temperature TA to the ECU 5.

An engine coolant temperature (TW) sensor 10, which may be formed of a thermistor or the like, is mounted in the cylinder block of the engine which is filled with coolant, for supplying an electric signal indicative of the sensed engine coolant temperature TW to the ECU 5. An engine rotational speed (NE) sensor 11 and a cylinder-discriminating (CYL) sensor 12 are arranged in facing relation to a camshaft or a crankshaft of the engine 1, neither of which is shown. The NE sensor 11 generates a signal pulse (hereinafter referred to as "a TDC signal pulse") at a predetermined crank angle before a top dead center (TDC) of each cylinder corresponding to the start of an intake stroke thereof whenever the crankshaft rotates through 180 degrees if the engine is a four-cylinder type, while the CYL sensor 12 generates a signal pulse at a predetermined crank angle of a particular cylinder of the engine, both of the pulses being supplied to the ECU 5.

A three-way catalyst (catalytic converter) 14 is arranged in an exhaust pipe 13 connected to the cylinder block of the engine 1, for purifying noxious components in exhaust gases from the engine, such as HC, CO, and NOx. Oxygen concentration sensors 16 and 17 as first and second oxygen concentration sensors are arranged in the exhaust pipe 13 at respective locations upstream and downstream of the three-way catalyst 13 (hereinafter referred to as "the upstream O2 sensor 16" and "the downstream O2 sensor 17"), for detecting the concentration of oxygen present in exhaust gases at their respective locations and supplying electric signals indicative of whether the air-fuel ratio of a mixture supplied to the engine 1 is richer or leaner than a stoichiometric air-fuel ratio, based on the sensed oxygen concentration to the ECU 5. More specifically, the upstream O2 sensor 16 and the downstream O2 sensor 17 each generate an output signal having a level higher than a reference level when the air-fuel ratio of the mixture is richer than the stoichiometric air-fuel ratio, and an output signal having a level lower than the reference level when the air-fuel ratio of the mixture is leaner than the stoichiometric air-fuel ratio.

The ECU 5 is comprised of an input circuit 5*a* having the functions of shaping the waveforms of input signals from various sensors mentioned above, shifting the voltage levels of sensor output signals to a predetermined level, converting analog signals from analog-output sensors to digital signals, and so forth, a central processing unit (hereinafter referred to as "the CPU") 5*b*, memory means 5*c* storing various operational programs which are executed by the CPU 5*b* and for storing results of calculations therefrom, etc., and an output circuit 5*d* which delivers driving signals to the fuel injection valves 6.

The CPU 5*b* operates in response to the above-mentioned signals from the sensors to determine operating conditions in which the engine 1 is operating, such as an air-fuel ratio feedback control region in which air-fuel ratio feedback control is carried out in response to the concentration of oxygen in exhaust gases detected by the upstream O2 sensor 16 and the downstream O2 sensor 17, and air-fuel ratio open-loop control regions, and calculates, based upon the determined engine operating conditions, the valve opening period or fuel injection period TOUT over which the fuel injection valves 6 are to be opened, by the use of the following equation (1), in synchronism with generation of TDC signal pulses:

$$TOUT = TI \times KO2 \times K1 + K2 \quad (1)$$

where TI represents a basic value of the fuel injection period TOUT, which is determined according to the engine rotational speed NE and the intake pipe absolute pressure PBA. A map for determining the TI value is stored in the memory means 5*c*.

KO2 represents an air-fuel ratio correction coefficient which is determined based on the output signal (output voltage PVO2) from the upstream O2 sensor 16 and the output signal (output voltage SVO2) from the downstream O2 sensor 17 such that the air-fuel ratio detected by the upstream O2 sensor 16 becomes equal to a desired air-fuel ratio when the engine 1 is operating in the air-fuel ratio feedback control region, while it is set to predetermined values corresponding to the respective air-fuel ratio open-loop control regions of the engine when the engine 1 is in the open-loop control regions.

K1 and K2 represent other correction coefficients and correction variables, respectively, which are set according to engine operating parameters to such values as optimize operating characteristics of the engine, such as fuel consumption and engine accelerability.

The CPU 5*b* supplies driving signals via the output circuit 5*d* to the fuel injection valves 6, based on the fuel injection period TOUT thus calculated, to drive the fuel injection valves 6.

Figure 2:
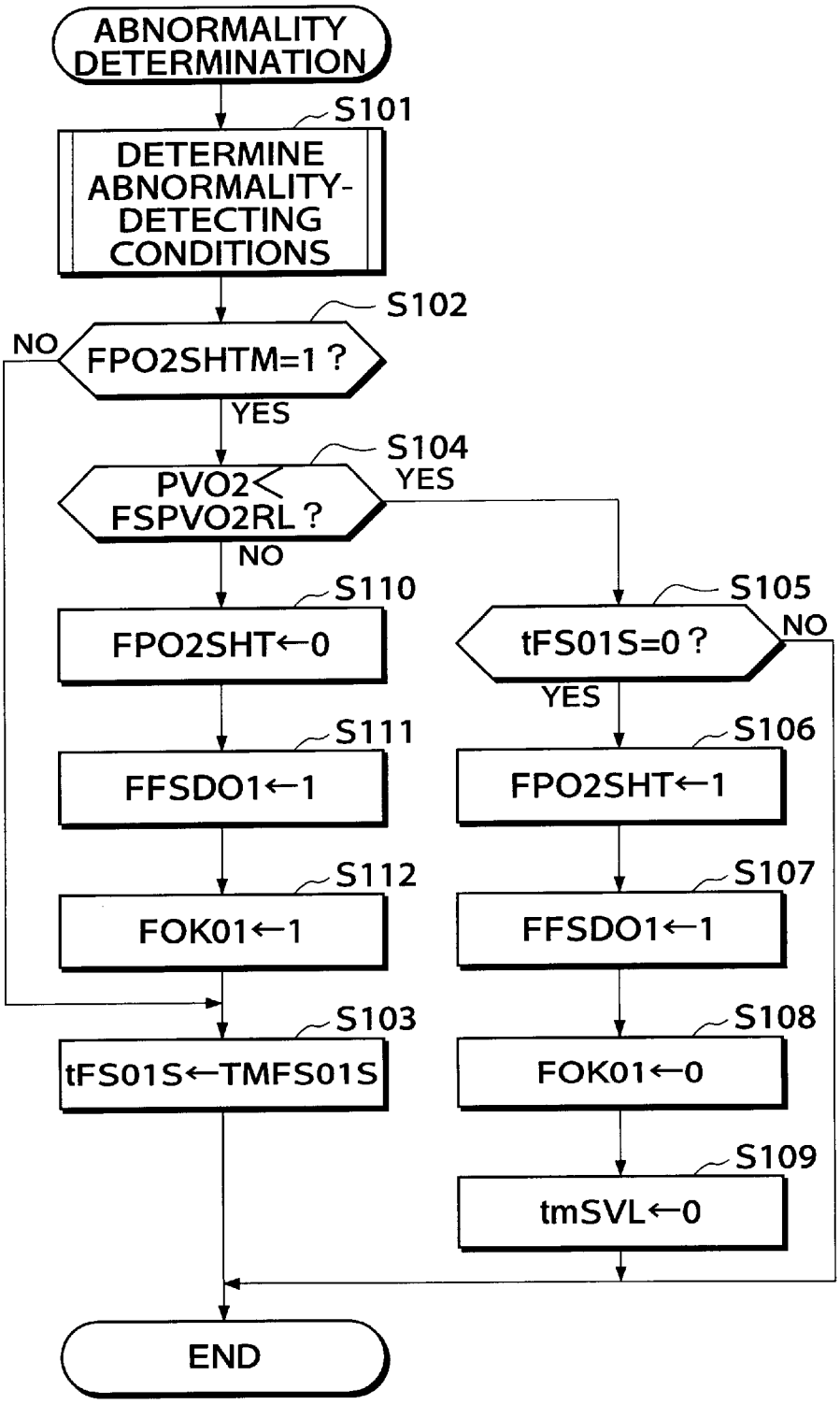
FIG. 2 is a flowchart showing a program for detecting abnormality of an upstream oxygen concentration sensor appearing in FIG. 1.

FIG. 2 shows a program for detecting abnormality of the upstream O2 sensor 16.

First, at a step S101, a process for determining abnormality-detecting conditions is executed to determine whether the engine 1 is in a condition under which the abnormality detection according to the present program can be carried out.

Figure 3:
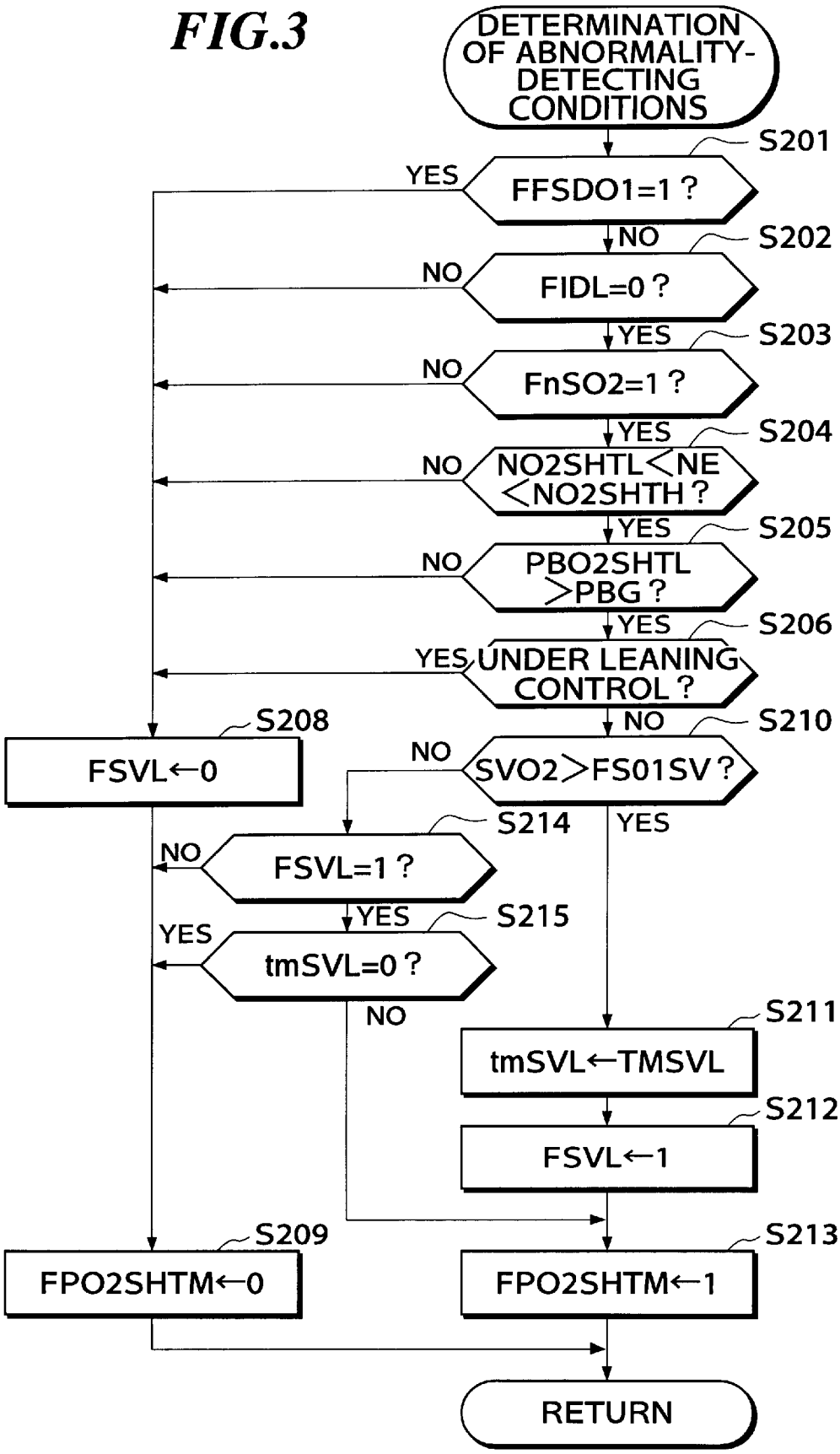
FIG. 3 is a flowchart showing a program for determining abnormality-detecting conditions, which is executed at a step S101 in FIG. 2.

FIG. 3 shows a program for carrying out the process for determining abnormality-detecting conditions, which is executed at the step S101.

At a step S201 in FIG. 3, it is determined whether or not an abnormality detection execution flag FFSDO1, which, when set to "1", indicates that a determination as to abnormality of the upstream O2 sensor 16 has been already made, assumes "1". If the flag FFSDO1 does not assume "1", i.e. the determination as to abnormality of the upstream O2 sensor 16 has been not yet made, it is determined whether or not a flag FIDLE, which, when set to "1", indicates that the engine 1 is idling, assumes "0" (step S202), whether or not a flag FnSO2, which, when set to "1", indicates that the downstream O2 sensor 17 has been activated (step S203), whether or not the engine rotational speed NE falls between a first predetermined value NO2SHTL (e.g. 1500 rpm) and a second predetermined value NO2SHTH (e.g. 5000 rpm) higher than the first predetermined value NO2SHTL (step S204), whether or not the intake pipe negative pressure PBG (gauge pressure) is lower than a threshold value PBO2SHTL (e.g. 300 mmHg) for determination of a high load condition of the engine, which is provided with hysteresis (step S205), and whether or not the air-fuel ratio of the mixture is being controlled to a leaner value than the stoichiometric air-fuel ratio (step S206).

If the answer to the question of the step S201 or S206 is affirmative (YES) or if the answer to the question of any of the steps S202 to S205 is negative (NO), a flag FSVL, which, when set to "1", indicates that the abnormality-detecting conditions are satisfied, is set to "0" at a step S208, and then an abnormality detection-enabling flag FPO2SHTM, which, when set to "1", indicates that the process for abnormality detection can be executed, is set to "0" at a step S209, followed by terminating the present program.

If the answers to the questions of the steps S201 and S206 are both negative (NO), and at the same time the answers to the questions of the steps S202 to S205 are all affirmative (YES), it is determined at a step S210 whether or not the output voltage SVO2 from the downstream O2 sensor 17 is higher than a reference value FSO1SV (e.g. 0.5 V), i.e. the output level of the downstream O2 sensor 17 is on a rich side with respect to the stoichiometric air-fuel ratio.

If it is determined at the step S210 that the output voltage SVO2 of the downstream O2 sensor 17 is higher than the reference voltage FSO1SV, a down-count timer tmSVL is set to a predetermined time period (e.g. 5 sec) and started, the flag FSVL is set to "1" at a step S212, and the abnormality detection-enabling flag FPO2SHTM is set to "1" at a step S213, followed by terminating the program.

The down-count timer tmSVL is provided to avoid that the detection of abnormality of the upstream O2 sensor 16 becomes impossible to carry out due to deterioration of the three-way catalyst 14 or the like. More specifically, the behavior of the downstream O2 sensor 17 depends upon the three-way catalyst 14 arranged between the upstream O2 sensor 16 and the downstream O2 sensor 17 such that the period of inversion of the output signal of the downstream O2 sensor 17 is relatively long when the three-way catalyst 14 is functioning normally (FIG. 4), while the inversion period becomes shorter as the three-way catalyst 14 becomes deteriorated with its oxygen-absorbing capacity degraded (FIG. 5), whereby the abnormality-detecting conditions becomes unsatisfied before execution of the abnormality detection, thus making it impossible to carry out the abnormality detection. In the present embodiment, in view of this fact, the abnormality detecting process is not terminated immediately when the output from the downstream O2 sensor 17 switches from the rich side to the lean side, but it is not assumed that the output from the downstream O2 sensor 17 has switched to the lean side until a predetermined time period TMSVL elapses from the switching of the output from the downstream O2 sensor 17 when the output from the sensor 17 becomes stable, so as to determine that the abnormality-detecting conditions for the upstream O2 sensor 16 are not satisfied, before the lapse of the predetermined time period TMSVL.

On the other hand, if it is determined at the step S210 that the output voltage SVO2 of the downstream O2 sensor 17 is lower than the reference voltage FSOlSV, i.e. the output level of the downstream O2 sensor 17 is on the lean side, it is determined at a step S214 whether or not the flag FSVL assumes "1", and if the flag FSVL assumes "1", it is determined at a step S215 whether or not the count value of the down-count timer tmSVL is equal to "0". If it is determined at the step S215 that the count value of the down-count timer tmSVL is not equal to "0", the abnormality detection-enabling flag FPO2HTM is set to "1" at the step S213, followed by terminating the program.

If the answer to the question of the step S214 is negative (NO), or if the answer to the question of the step S215 is affirmative (YES), the abnormality detection-enabling flag FPO2SHTM is set to "0" at the step S209, followed by terminating the program.

Referring again to FIG. 2, at a step S102, it is determined whether or not the abnormality detection-enabling flag FPO2SHTM assumes "1". If FPO2SHTM="0" holds, a down-count timer tFS01S for abnormality detection is set to a predetermined time period TMFS01S (e.g. 10 sec), followed by terminating the program.

If it is determined at the step S102 that the abnormality detection-enabling flag FPO2SHTM assumes "1", it is determined at a step S104 whether or not the output voltage PVO2 from the upstream O2 sensor 16 is lower than a reference voltage FSPVO2RL (e.g. 0.06 V).

If it is determined at the step S104 that the output voltage PVO2 from the upstream O2 sensor 16 is lower than the reference voltage FSPVO2RL, i.e. the output level of the upstream O2 sensor 16 is on the lean side, it is determined at a step S105 whether or not the abnormality detection down-count timer tFS01S is equal to "0".

If it is determined at the step S105 that the abnormality detection down-count timer tFS01S is equal to "0", i.e. the output level of the upstream O2 sensor 16 has been on the lean side over the predetermined time period TMFS01S even though the output level of the downstream O2 sensor 17 is on the rich side, it can be considered that there occurs a short-circuit in the upstream O2 sensor 16, i.e. a short-circuit in the sensor body or wiring thereof. Therefore, then a flag FPO2SHT, which, when set to "1", indicates that there is a short-circuit in the upstream O2 sensor 16, is set to "1" at a step S106, the flag FFSDO1 is set to "1" at a step S107, a flag FOK01, which, when set to "1", indicates that the upstream O2 sensor 16 is functioning normally, is set to "O" at a step S108, and the down-count timer tmSVL is set to "O" at a step S109, followed by terminating the program.

If it is determined at the step S104 that the output voltage PVO2 of the upstream O2 sensor 16 is higher than the reference voltage FSPVO2RL, i.e. the output level of the upstream O2 sensor 16 is on the rich side, it can be considered that there is no short-circuit in the upstream O2 sensor 16. Therefore, then the flag FPO2SHT is set to "0" at a step S110, the flag FFSDO1 is set to "1" at a step S111, the flag FOK01 is set to "1" at a step S112, and the abnormality detection down-count timer tFS01S is set to the predetermined time period TMFSO1S at the step S103, followed by terminating the program.

Figure 4:
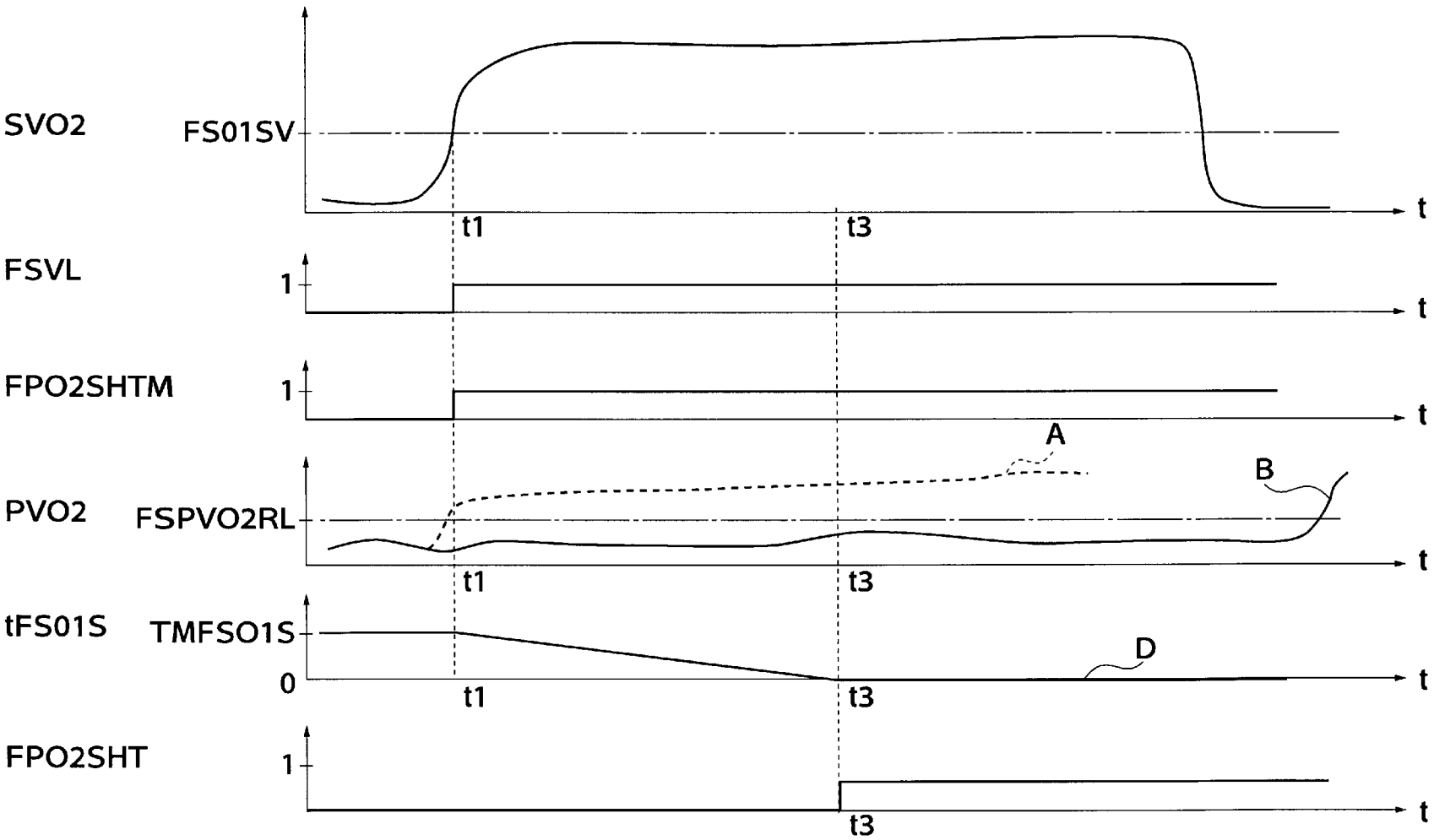
FIG. 4 is a graph useful in explaining the manner of abnormality detection shown in FIG. 2 and the manner of determining abnormality-detecting conditions shown in FIG. 3.
Figure 5:
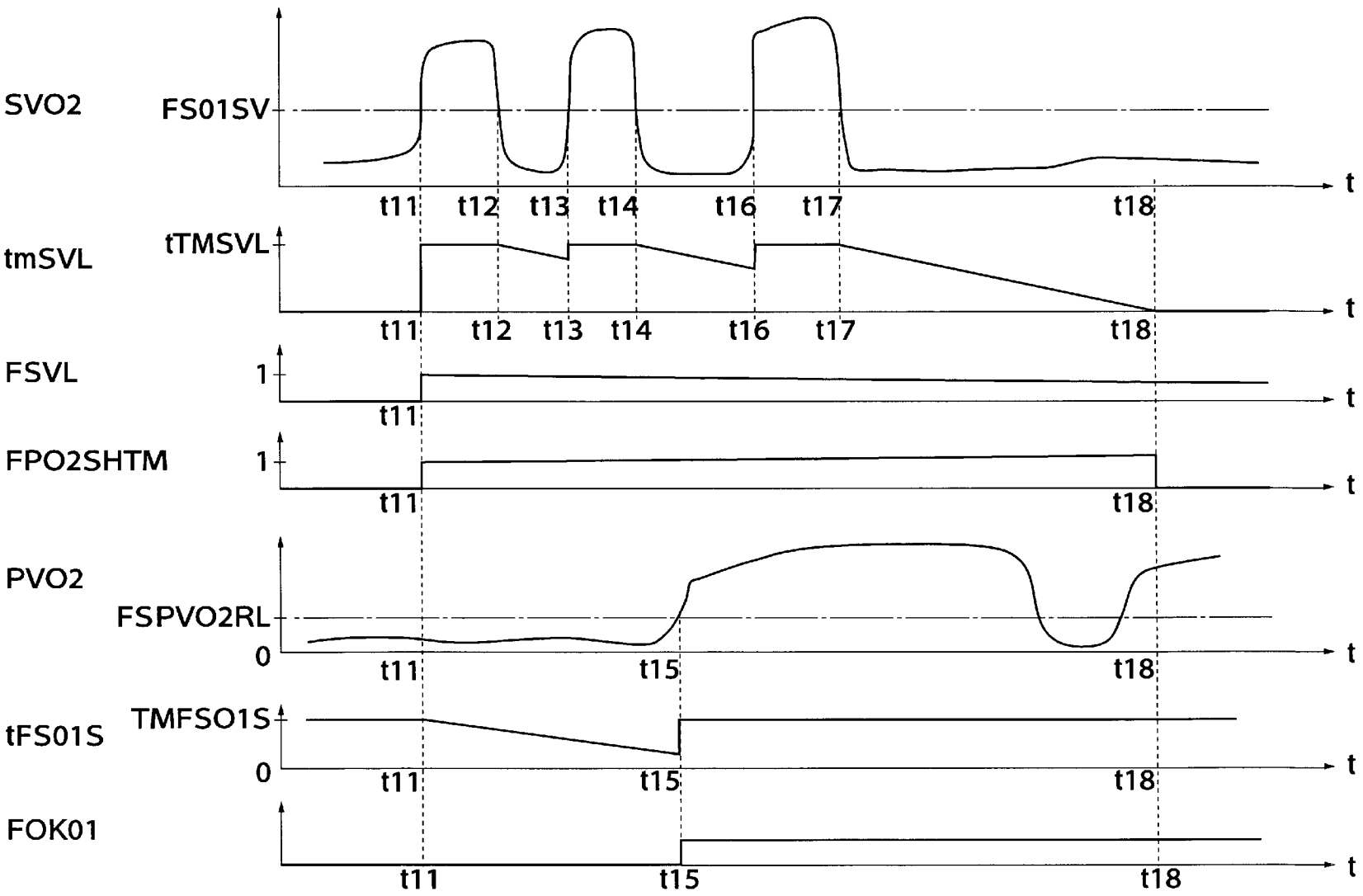
FIG. 5 is a graph useful in explaining the manner of abnormality detection shown in FIG. 2 and the manner of determining abnormality-detecting conditions shown in FIG. 3.

FIGS. 4 and 5 are timing charts useful in explaining examples of the abnormality detection according to the programs of FIGS. 2 and 3. FIG. 4 shows changes with the lapse of time in the output voltage SVO2 of the downstream O2 sensor 17, the flag FSVL, the abnormality detection-enabling flag FPO2SHTM. the output voltage PVO2 of the upstream O2 sensor 16, the count value of the abnormality determination down-count timer tFS01S, and the flag FPO2SHT indicative of whether the upstream O2 sensor 16 is short-circuited. FIG. 5 shows changes with the lapse of time in the output voltage SVO2 of the downstream O2 sensor 17, the count value of the down-count timer tmSVL, the flag FSVL, the abnormality detection-enabling flag FPO2SHTM. the output voltage PVO2 of the upstream O2 sensor 16, the abnormality determination down-count timer tFS01S, and the flag FOK01S indicative of whether the upstream O2 asensor 16 is functioning normally.

FIG. 4 shows an example of abnormality-detecting operation in the case where the output voltage SVO2 of the downstream O2 sensor 17 changes above the reference voltage FS01SV, i.e. the output voltage SVO2 is inverted from the lean side to the rich side at a time point t1.

When the output voltage SVO2 of the downstream O2 sensor 17 changes above the reference voltage FS01SV, i.e. the output voltage SVO2 is inverted from the lean side to the rich side at the time point t1, the flag FSVL and the abnormal detection-enabling flag FPO2SHTM are both set to "1" (steps S212, S213). Therefore, the answer to the question of the step S102 becomes affirmative (YES), so that counting-down of the abnormality determination down-count timer tFS01S is started.

Normally, the output voltage PVO2 of the upstream O2 sensor 16 is inverted from the lean side to the rich side before the output voltage SVO2 of the downstream O2 sensor 17 changes accordingly, as indicated by the broken line A. Therefore, by the time the flag FPO2HTM is set to "1", the output voltage PVO2 of the upstream O2 sensor 16 has already become higher than the reference voltage FSPVO2RL, so that the answer to the question of the step S104 becomes negative (NO), leading to a determination that the upstream O2 sensor 16 is functioning normally. Therefore, the abnormality detection execution flag FFSDO1 is set to "1" (step S111), and hence the abnormality detection-enabling flag FPO2SHTM is set to "0" (steps S201, S209).

On the other hand, if the output voltage PVO2 of the upstream O2 sensor 16 continues to be lower than the reference voltage FSPVO2RL, i.e. the output level of the upstream O2 sensor 16 continues to be on the lean side until the count value of the abnormality determination down-count timer tF01S decreases to "0" at a time point t3 (the answer to the question of the step S105 becomes affirmative (YES)), as indicated by the solid line B, it is determined that the upstream O2 sensor 16 is short-circuited. That is, the flag FPO2SHT is set to "1" to indicate that the upstream O2 sensor 16 is short-circuited (step S106).

FIG. 5 shows an example of abnormality detecting operation in the case where the period of inversion of the output voltage SVO2 of the downstream O2 sensor 17 has become shortened due to deterioration of the three-way catalyst 14, as is distinct from the case of FIG. 4.

When the output voltage SVO2 of the downstream O2 sensor 17 changes above the reference voltage FSO1SV (the output level of the downstream O2 sensor 17 is inverted from the lean side to the rich side) at a time point till, the flag FSVL and the abnormality detection-enabling flag FPO2SHTM are both set to "1" (steps S212, S213). Therefore, the answer to the question of the step S102 becomes affirmative (YES), and counting-down of the abnormality determination down-count timer tFS01S is started. When the output level of the downstream O2 sensor 17 is subsequently inverted to the lean side at a time point t12, counting-down of the down-count timer tmSVL is started. However, the output level of the downstream O2 sensor 17 is again inverted to the rich side at a time point t13 when the count value of the down-count timer tmSVL does not yet reach "0", so that the abnormality detecting operation is not interrupted, and counting-down of the down-count timer tFS01S is continued from the time point t11.

Subsequently, when the output voltage PVO2 of the upstream O2 sensor 16 changes above the reference voltage FSPVO2RL (the output level of the upstream O2 sensor 16 is inverted to the rich side) at a time point t15 when the count value of the abnormality detection down-count timer tFS01S does not yet reach "0", the answer to the question of the step S104 becomes negative (NO), whereby it is determined that the upstream O2 sensor 16 is functioning normally. Therefore, at the time point t15, the flag FOK01 is set to "1" to indicate that the upstream O2 sensor 16 is functioning normally (step S111).

The down-count timer tmSVL is reset at a time point t16 and caused to start counting-down at a time point t17 in response to inversion of the output voltage SVO2 of the downstream O2 sensor 17. When the count value of the down-count timer tmSVL reaches "0" at a time point t18, the answer to the question of the step S215 becomes affirmative (YES), so that the abnormality detection-enabling flag FPO2SHTM is set to "0" since then it is considered that the output level of the downstream O2 sensor 17 stably remains on the lean side.

As described above, according to the present embodiment, the abnormality detection of the upstream O2 sensor 16 is carried out when the output level of the downstream O2 sensor 17 is on the rich side, i.e. when it is ascertained that the air-fuel ratio is surely rich. As a result, the timing of execution of the abnormality detection is not limited to occasions of increase of the fuel amount supplied to the engine as in the prior art, and therefore, it is possible to carry out the abnormality detection at a higher frequency.

Further, since the abnormality detection of the upstream O2 sensor 16 is carried out only after it is ascertained that the air-fuel ratio is rich, based on the output level of the downstream O2 sensor 17, erroneous detection of abnormality of the upstream O2 sensor 16 can be avoided even in the case where the air-fuel ratio cannot be positively made rich even through control of the fuel supply amount to an increased amount due to variations in the composition of the fuel or other factors, or in the case where the air-fuel ratio cannot be made rich even through control of the fuel supply amount to an increased amount due to setting of a fuel increasing coefficient used in the control to a small value.

What is claimed is:

1. An oxygen concentration sensor abnormality-detecting system for an internal combustion engine having an exhaust system, a catalytic converter arranged in said exhaust system, and first and second oxygen concentration sensors arranged in said exhaust system at respective locations upstream and downstream of said catalytic converter, comprising abnormality-determining means for determining that said first oxygen concentration sensor is functioning abnormally if an output from said first oxygen concentration sensor does not change when an output from said second oxygen concentration sensor changes.

2. An oxygen concentration sensor abnormality-detecting system as claimed in claim 1, wherein said abnormality-determining means determines that said first oxygen concentration sensor is functioning abnormally if said output from said first oxygen concentration sensor stays in a direction such that an air-fuel ratio of a mixture supplied to said engine is leaner than a stoichiometric air-fuel ratio when said output from said second oxygen concentration sensor has changed in a direction such that the air-fuel ratio of said mixture is richer than said stoichiometric air-fuel ratio.

3. An oxygen concentration sensor abnormality-detecting system as claimed in claim 1, wherein said abnormality-determining means determines that said first oxygen concentration sensor is functioning abnormally if said output from said first oxygen concentration sensor has continued to indicate that an air-fuel ratio of a mixture supplied to said engine is leaner than a stoichiometric air-fuel ratio, over a predetermined time period when said output from said second oxygen concentration sensor indicates that the air-fuel ratio of said mixture is richer than said stoichiometric air-fuel ratio.

* * * * *